US008251209B2

(12) United States Patent
Shiao

(10) Patent No.: US 8,251,209 B2
(45) Date of Patent: Aug. 28, 2012

(54) GOLF BAG WITH CROSSBEAM ASSEMBLIES

(76) Inventor: Kun-Lin Shiao, Yangmei Chen (TW)

( * ) Notice: Subject to any disclaimer, the term of this patent is extended or adjusted under 35 U.S.C. 154(b) by 457 days.

(21) Appl. No.: 12/654,853

(22) Filed: Jan. 6, 2010

(65) Prior Publication Data

US 2011/0162985 A1 Jul. 7, 2011

(51) Int. Cl.
*A63B 55/00* (2006.01)

(52) U.S. Cl. ..... 206/315.8; 220/9.3

(58) Field of Classification Search ..... 206/315.8; 220/9.2, 9.3
See application file for complete search history.

(56) References Cited

U.S. PATENT DOCUMENTS

| | | | | | |
|---|---|---|---|---|---|
| 702,650 | A | * | 6/1902 | Hazen | 220/9.2 |
| 1,155,475 | A | * | 10/1915 | Fay | 220/9.3 |
| 1,939,488 | A | * | 12/1933 | Dent et al. | 206/315.8 |
| 2,710,084 | A | * | 6/1955 | Braverman | 190/107 |
| 5,353,900 | A | * | 10/1994 | Stilley | 190/18 A |

* cited by examiner

*Primary Examiner* — Tri Mai
(74) *Attorney, Agent, or Firm* — Bacon & Thomas, PLLC

(57) ABSTRACT

A golf bag has a bottom base, multiple supporting rods, a top frame, a covering and multiple crossbeam assemblies. The supporting rods are mounted between the bottom base and top frame and are covered by the covering. Each crossbeam assembly has a pair of crossbeam members mounted between adjacent two supporting rods. Each crossbeam member has an engaging slot and an engaging protrusion engaged respectively with the engaging protrusion and engaging slot of the other crossbeam member to prevent the golf bag from inadvertently twisting.

7 Claims, 6 Drawing Sheets

GOLF BAG WITH CROSSBEAM ASSEMBLIES

BACKGROUND OF THE INVENTION

1. Field of the Invention

The present invention relates to a golf bag, and more particularly to a golf bag has supporting rods and crossbeam assemblies each mounted transversely between adjacent supporting rods to prevent the golf bag from inadvertently twisting and breaking.

2. Description of Related Art

Golf bags hold golf clubs. A conventional golf bag is cylindrical and has a flat bottom so that the golf bag can stand upright on the ground. However, the grass of most golf courses is not flat. A golf bag standing on the grass may easily fall over.

A conventional golf bag is tubular golf bag and has a bottom base, a top frame, a supporting tube and a covering. The supporting tube is made of plastic and cylindrical, is mounted between the bottom base and the top frame. The supporting tube serves as a supporting framework to maintain the shape of the tubular golf bag. The covering is mounted around the supporting tube to improve the attraction of the tubular golf bag. However, the supporting tube is heavy and disadvantages transportation of the golf bag.

Another conventional golf bag is a rod-constructed golf bag without using supporting tube and comprises a bottom base, multiple supporting rods, a top frame and a covering. The supporting rods are mounted vertically and securely on the bottom base and each supporting rod has a bottom end and a top ends. The top frame is mounted on the top ends of the supporting rods. The covering is soft, may be made of plastic or rubber, is mounted between the bottom base and top frame and covers the supporting rods. The supporting rods are lighter and cheaper than aforementioned supporting tube so facilitate the transportation thereof.

However, the supporting rods are parallel at intervals without any lateral fasteners to connect adjacent two supporting rods. Therefore, the golf bag is easily twisted and disassembled and/or damaged.

To overcome the shortcomings, the present invention provides a golf bag with crossbeam assemblies to mitigate or obviate the aforementioned problems.

SUMMARY OF THE INVENTION

The main objective of the invention is to provide a golf bag has supporting rods and crossbeam assemblies each mounted transversely between adjacent supporting rods to prevent the golf bag from inadvertently twisting and breaking.

A golf bag in accordance with the present invention has a bottom base, multiple supporting rods, a top frame, a covering and multiple crossbeam assemblies. The supporting rods are mounted between the bottom base and top frame and are covered by the covering. Each crossbeam assembly has a pair of crossbeam members mounted between adjacent two supporting rods. Each crossbeam member has an engaging slot and an engaging protrusion engaged respectively with the engaging protrusion and engaging slot of the other crossbeam member to prevent the golf bag from inadvertently twisting.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
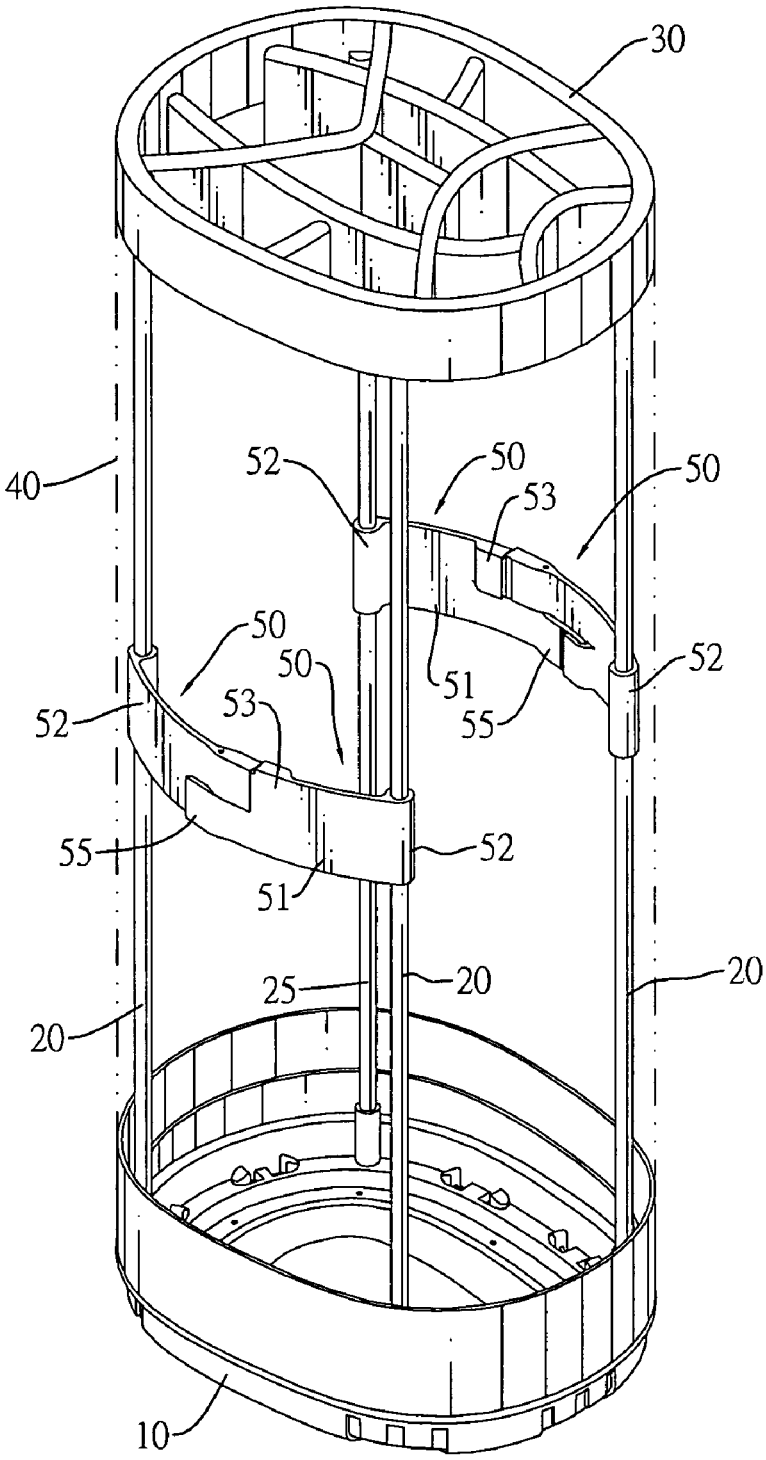
FIG. 1 is a perspective view of a golf bag with crossbeam assemblies in accordance with the present invention.
Figure 2:
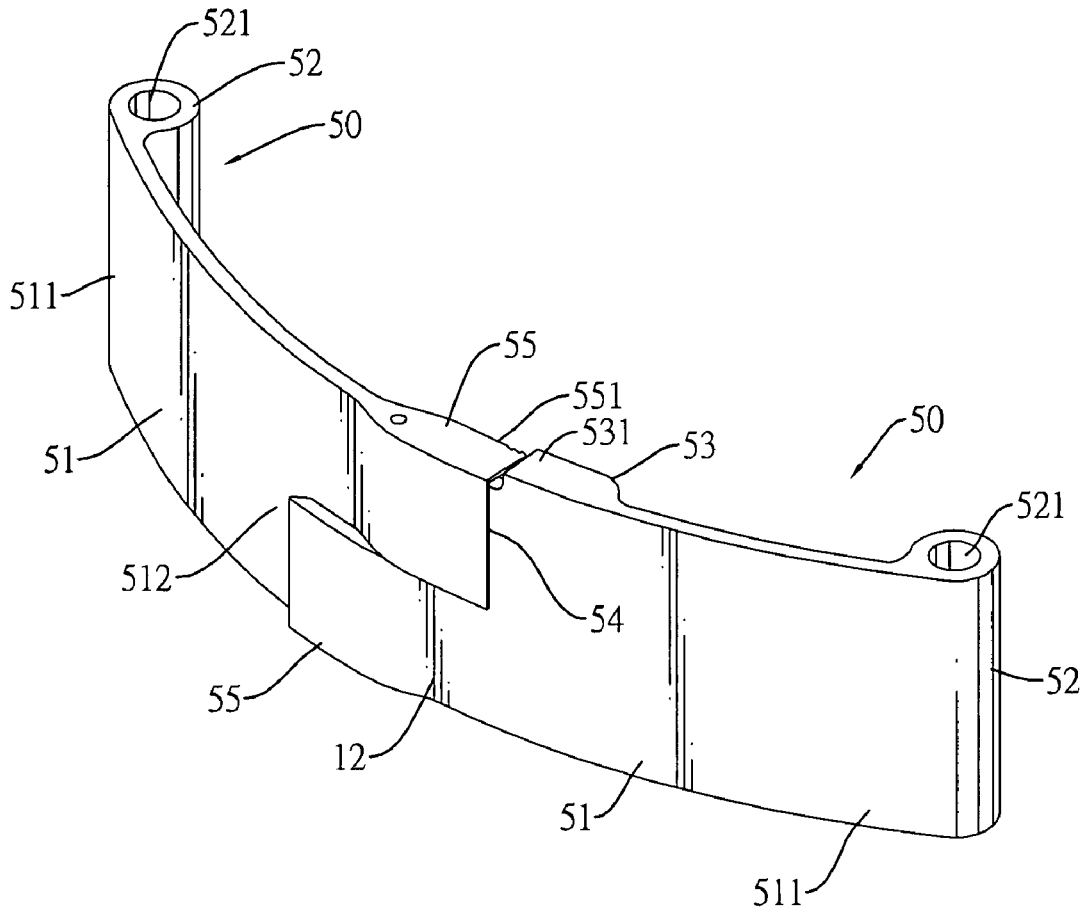
FIG. 2 is a perspective view of a crossbeam assembly in FIG. 1.
Figure 3:
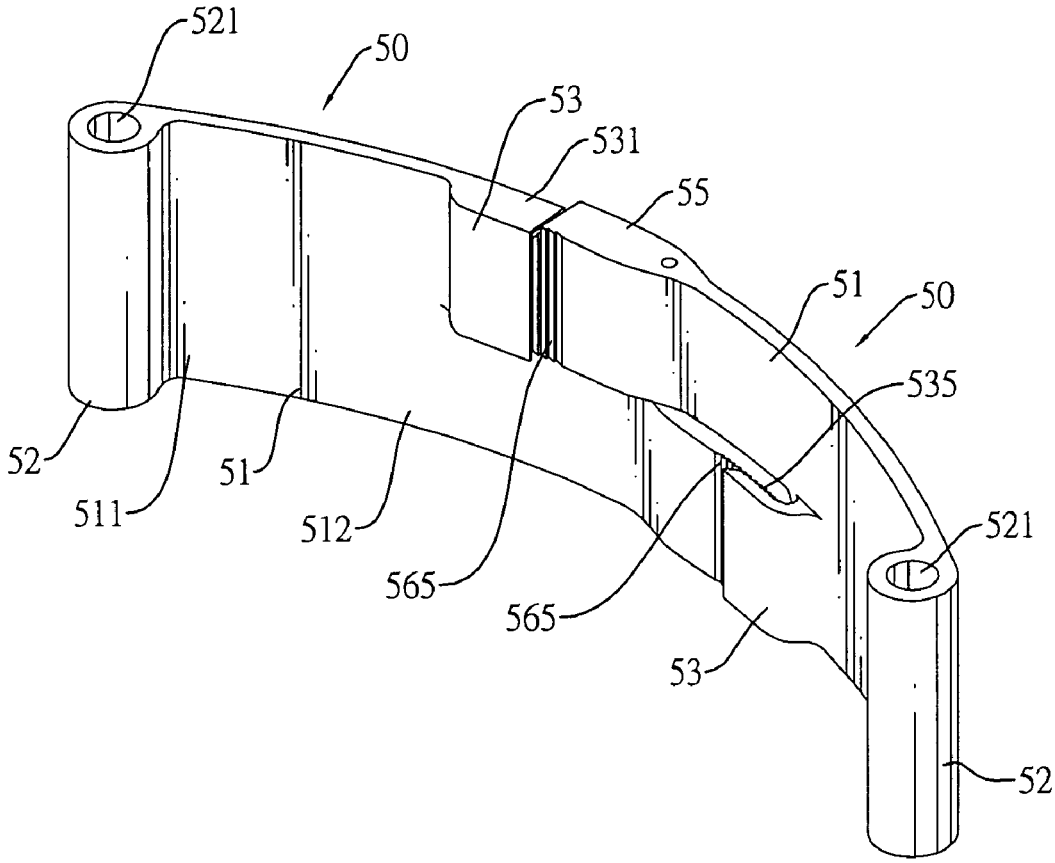
FIG. 3 is another perspective of the crossbeam assembly in FIG. 2.

With reference to FIGS. 1 to 3, a golf bag in accordance with the present invention is a rod-constructed golf bag, is designed for anti-twist purposes and comprises a bottom base (10), multiple supporting rods (20), a top frame (30), a covering (40) and multiple crossbeam assemblies.

The bottom base (10) may have multiple mounting sleeves formed thereon.

The supporting rods (20) are mounted substantially vertically and securely on the bottom base (10), are parallel to each other at intervals and each supporting rod (20) has a bottom end and a top end. The bottom end is mounted securely on the bottom base (10) and may be mounted in one of the mounting sleeves.

The top frame (30) is hollow for golf club insertion purposes and is mounted on the top ends of the supporting rods (20).

The covering (40) is mounted between the bottom base (10) and the top frame (20) and covers the supporting rods (20).

The crossbeam assemblies are mounted transversely and respectively between two adjacent supporting rods (20) and each crossbeam assembly has a pair of crossbeam members (50). The crossbeam members (50) are mounted respectively the adjacent supporting rods (20) and are engaged with each other. The engaged crossbeam members (50) provide a horizontally supporting force that holds and ensures the adjacent supporting rods (20) in parallel and prevents the adjacent supporting rods (20) from turning into a configuration of two oblique lines twisting the golf bag. In other words, the crossbeam assemblies effectively prevent the golf bag from inadvertently twisting.

Figure 4:
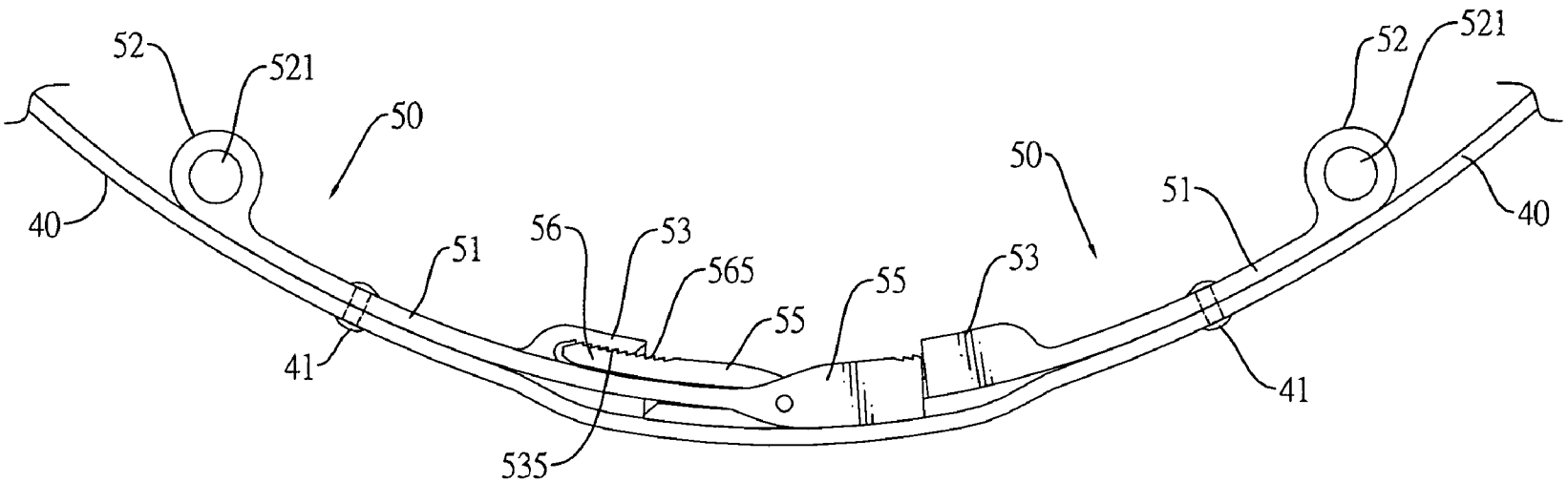
FIG. 4 is a top view of the golf bag in FIG. 1 showing that the crossbeam assembly is mounted on the inner surface of the covering through fasteners.
Figure 5:
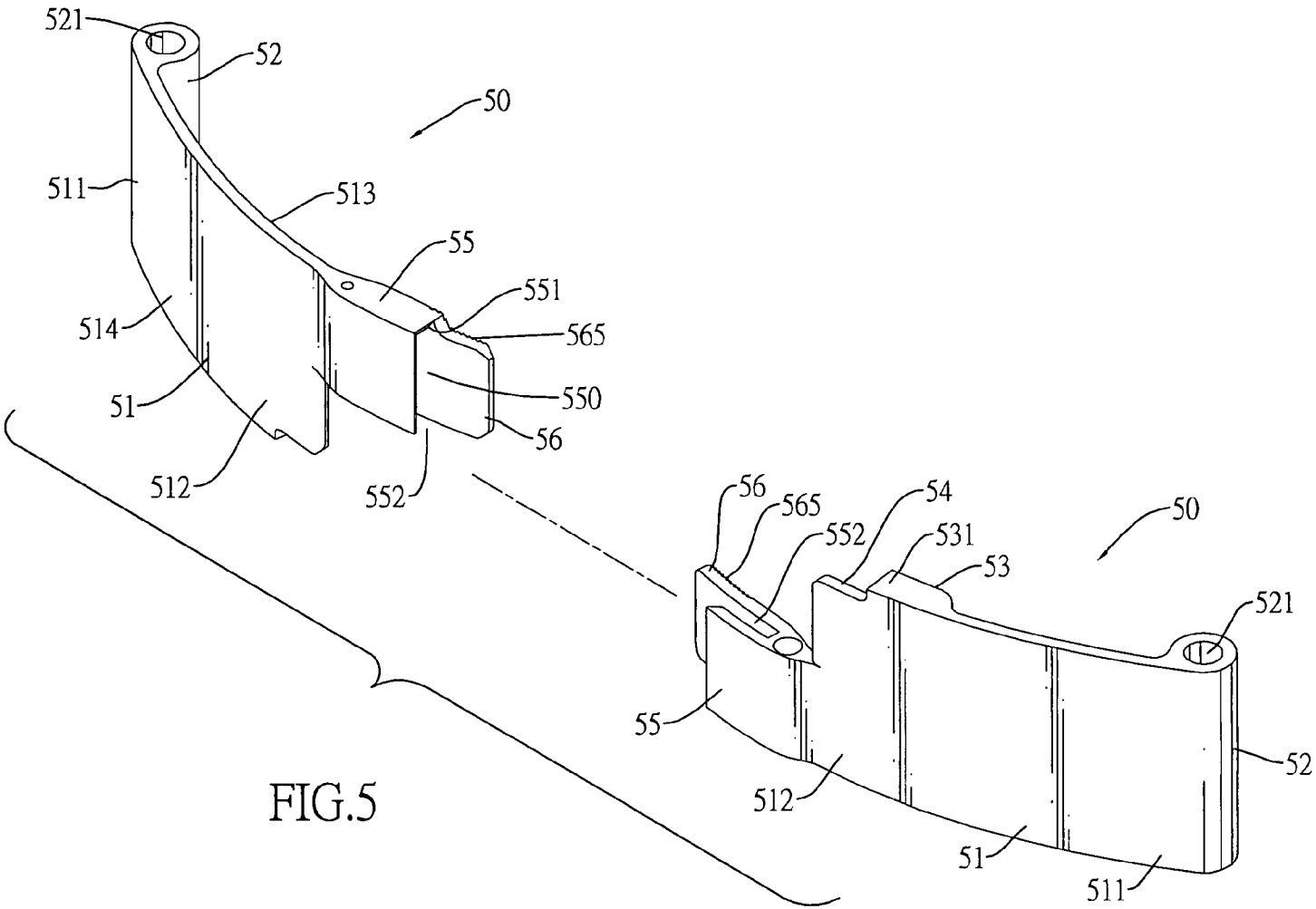
FIG. 5 is an exploded perspective view of the crossbeam assembly in FIG. 2.
Figure 6:
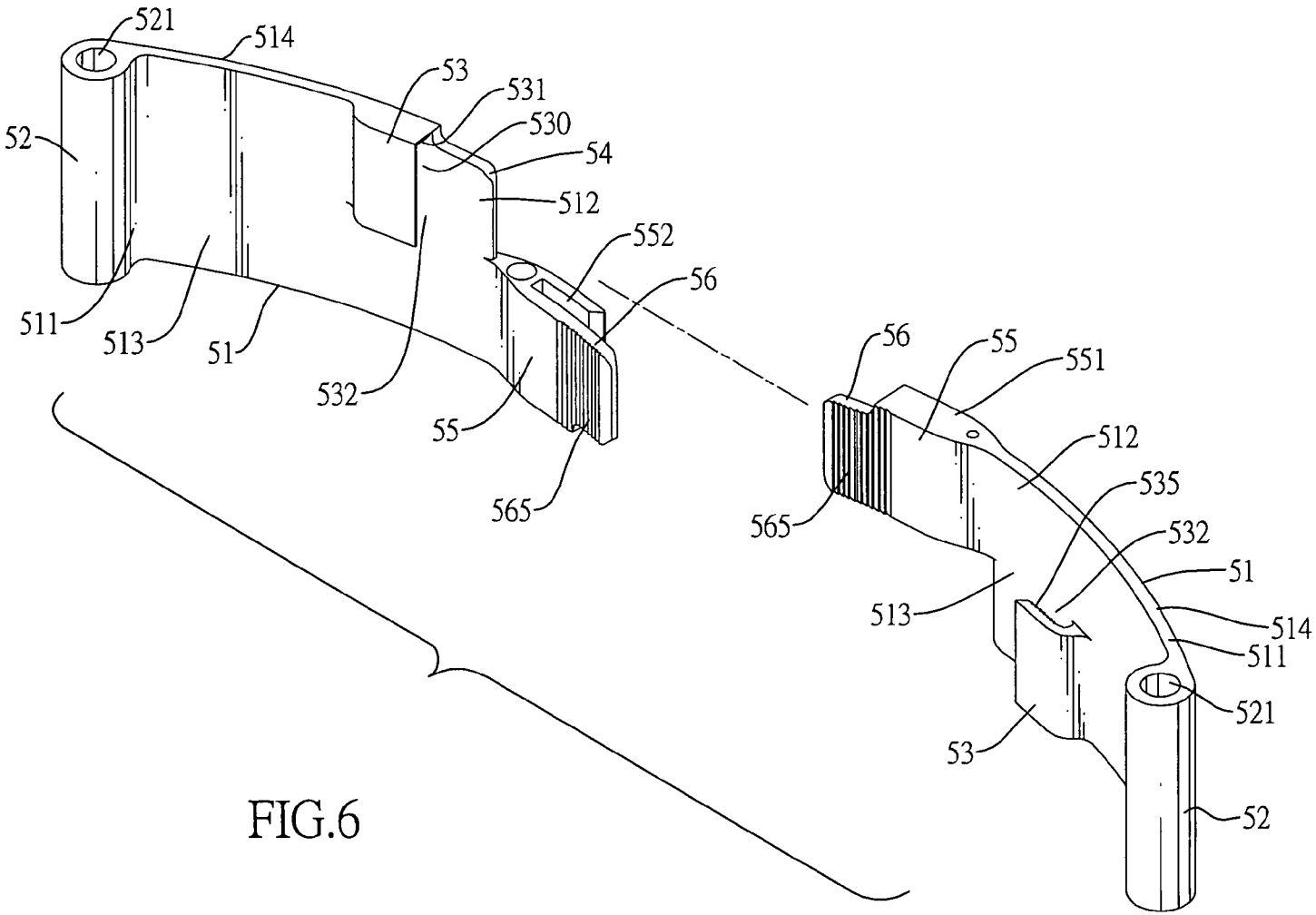
FIG. 6 is another exploded perspective view of the crossbeam assembly in FIG. 5.

With further reference to FIGS. 4 to 6, each crossbeam member (50) may be curved and has a body (51), a pivoting member (52), a first engaging element (53), and a second engaging element (55).

The body (51) may be curved and has a connecting end (511), an engaging end (512), an inner surface (513) and an outer surface (514). The engaging end (512) is defined opposite to the connecting end (511). The inner surface (513) may be a concavity. The outer surface (514) is defined opposite to the inner surface (513) and may be a convexity.

The pivoting member (52) is formed on the connecting end (511) of the body (51) and is mounted rotatably around one of the adjacent supporting rods (20). The pivoting member (52) may have a pivot hole (521) defined through the pivoting member (52) and mounted around one of the adjacent supporting rods (20).

The first engaging element (53) is formed on the inner surface (513) of the body (51) and has two opposite sides, an outside end, a first engaging slot (530) and a first engaging protrusion (54).

The opposite sides may be a closed side (531) and an open side (532).

The first engaging slot (530) is defined in the outside end, may communicate with the open side (532) and may have an inner surface and multiple first teeth (535) formed on the inner surface.

The first engaging protrusion (54) is formed on and protrudes longitudinally from the outside end.

The second engaging element (55) is formed on and protrudes longitudinally from the engaging end (512) of the body (51) and is selectively engaged with first engaging element (55) of the other crossbeam member (50) of the pair. Each second engaging element (55) has two opposite sides, an outside end, a second engaging slot (550) and a second engaging protrusion (56).

The opposite sides may be a closed side (551) and an open side (552) defined opposite to the open side (532) of the first engaging element (53).

The second engaging slot (550) is defined in the outside end, may communicate with the open side (552) and is engaged with the first engaging protrusion (54) of the other crossbeam member (50) of the pair. In a preferred embodiment, the closed side (551) of the second engaging element (55) of one crossbeam member (50) abuts the first engaging protrusion (54) of the other crossbeam member (50) to prevent the first engaging protrusion (54) from being separated inadvertently from the second engaging slot (550).

The second engaging protrusion (56) is formed on and protrudes longitudinally from the outside end of the second engaging element (55), is selectively engaged with the first engaging slot (530) and may have multiple second teeth (565). The second teeth (565) are formed on the second engaging protrusion (56) and are engaged with the first teeth (535) of the first engaging element (53) of the other crossbeam of the pair. In a preferred embodiment, the second engaging protrusion (56) of one crossbeam member (50) abuts the closed side (531) of the first engaging element (53) of the other crossbeam member (50) to prevent the second engaging protrusion (56) from slipping transversely and falling out of the first engaging slot (530).

Furthermore, in a preferred embodiment, each crossbeam member (50) is mounted securely on the covering (40) through a fastener (41) such as a rivet, a bolt or adhesive agent to reinforce a whole structural strength of the golf bag.

The crossbeam assemblies respectively connecting the pairs of adjacent supporting rods (20) ensure that the supporting rods (20) parallel each other. The supporting rods (20) connected transversely by the crossbeam assemblies would not inadvertently change to a configuration of oblique lines. Therefore, the golf bag with the crossbeam assemblies would not inadvertently twist and the so that the structural strength and durability of the golf bag are improved excellently.

Furthermore, the curved crossbeam members (50) with the convexity of the outer surface (514) of the bodies (51) serves as an internal frame to hold and shape the covering (40) into a cylinder-like configuration for improving the aesthetic of the appearance of the golf bag.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A golf bag comprising:

a bottom base;

multiple supporting rods mounted substantially vertically and securely on the bottom base and each supporting rod has a bottom end and a top end;

a top frame mounted on the top ends of the supporting rods;

a covering covering the supporting rods; and at least one crossbeam assembly, wherein each of the at least one crossbeam assembly is mounted between adjacent two of the supporting rods and has a pair of crossbeam members, the crossbeam members are engaged with the each other and each crossbeam member has a body having a connecting end;

an engaging end;

an inner surface; and an outer surface;

a pivoting member formed on the connecting end of the body and mounted rotatably around one of the adjacent two of the supporting rods;

a first engaging element formed on the inner surface of the body and having two opposite sides;

an outside end;

a first engaging slot defined in the outside end; and a first engaging protrusion formed on and protruding from the outside end; and a second engaging element formed on and protruding longitudinally from the engaging end of the body, selectively engaged with first engaging element of the other crossbeam member of the pair, and each second engaging element having two opposite sides;

an outside end;

a second engaging slot defined in the outside end of the second engaging element and engaged with the first engaging protrusion of the other crossbeam member of the pair; and a second engaging protrusion formed on and protruding from the outside end of the second engaging element and selectively engaged with the first engaging slot.

2. The golf bag as claimed in claim 1, wherein the body of each crossbeam member is curved and has the outer surface being a convexity.

3. The golf bag as claimed in claim 2, wherein the inner surface of the body of each crossbeam member is a concavity.

4. The golf bag as claimed in claim 1, wherein the opposite sides of the first engaging element of each crossbeam member are a closed side and an open side communicating with the first engaging slot; and the second engaging protrusion of one crossbeam member of the pair abuts the closed side of the first engaging element of the other crossbeam member.

5. The golf bag as claimed in claim 4, wherein the opposite sides of the second engaging element of each crossbeam member are a closed side and an open side communicating with the second engaging slot; and the closed side of the second engaging element of one crossbeam member of the pair abuts the first engaging protrusion of the other crossbeam member.

6. The golf bag as claimed in claim 1, wherein the first engaging slot of each crossbeam member has an inner surface and multiple first teeth formed on the inner surface; and the second engaging protrusion of each crossbeam member of the pair has multiple second teeth formed on the second engaging protrusion and engaged with the first teeth of the first engaging element of the other crossbeam member.

7. The golf bag as claimed in claim 1, wherein each crossbeam member is mounted on the covering through at least one fastener.

* * * * *